US007431055B2

(12) United States Patent
Debaes et al.

(10) Patent No.: US 7,431,055 B2
(45) Date of Patent: Oct. 7, 2008

(54) METHOD FOR WEAVING FABRICS WITH AREAS HAVING A CORDED STRUCTURE WITH A LARGE VARIETY OF COLOUR EFFECTS

(75) Inventors: Johny Debaes, Moorslede (BE); Ludo Smissaert, Assebroek (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 70 days.

(21) Appl. No.: 11/594,245

(22) Filed: Nov. 8, 2006

(65) Prior Publication Data

US 2007/0102056 A1 May 10, 2007

(30) Foreign Application Priority Data

Nov. 10, 2005 (BE) ..... 2005/0547

(51) Int. Cl.

| | |
|---|---|
| ***D03D 27/06*** | (2006.01) |
| ***D03D 39/00*** | (2006.01) |
| ***D03D 39/10*** | (2006.01) |
| *D03C 13/00* | (2006.01) |
| *D03C 11/00* | (2006.01) |

(52) U.S. Cl. ..... 139/21; 139/20; 139/37; 139/116.5; 139/404

(58) Field of Classification Search ..... 139/20, 139/21, 37, 116.5, 391, 397, 407, 408, 409, 139/410

See application file for complete search history.

(56) References Cited

U.S. PATENT DOCUMENTS

| | | | | |
|---|---|---|---|---|
| 939,230 | A | 11/1909 | Dornan | |
| 3,563,282 | A * | 2/1971 | Gonon | 139/390 |
| 5,398,730 | A * | 3/1995 | Derudder et al. | 139/21 |
| 5,655,573 | A * | 8/1997 | Gheysen et al. | 139/21 |
| 6,173,746 | B1 * | 1/2001 | Debaes et al. | 139/392 |
| 6,186,186 | B1 * | 2/2001 | Debaes et al. | 139/21 |
| 6,186,189 | B1 * | 2/2001 | Gheysen | 139/392 |
| 6,247,506 | B1 * | 6/2001 | Debaes et al. | 139/402 |
| 6,289,941 | B1 * | 9/2001 | Debaes | 139/402 |
| 6,343,626 | B1 * | 2/2002 | Demey et al. | 139/398 |

(Continued)

FOREIGN PATENT DOCUMENTS

| | | |
|---|---|---|
| BE | 1012590 | 12/2000 |

(Continued)

*Primary Examiner*—Bobby H Muromoto, Jr.
(74) *Attorney, Agent, or Firm*—James Creighton Wray; Clifford D. Hyra

(57) ABSTRACT

A method for weaving a pile fabric with areas having a corded structure, a backing fabric being woven on a weaving machine by inserting backing weft yarns during successive weft insertion cycles between binding and tension warp yarns, while pattern-weft yarns are inserted outside the backing fabric, and are covered by pile warp yarns forming cords. Successive series of different pattern-weft yarns are inserted into the pile fabric in areas having a corded structure and at least one pattern-weft yarn of each series is running essentially above the warp yarns in a first part of its trajectory and is forming the pattern, and is covered by pile warp yarns essentially forming cords in a second part of its trajectory, so that a predetermined pattern or design is formed. This enables the color palette and/or the effect palette to be modified across the width of the weaving machine with weft effects.

27 Claims, 5 Drawing Sheets

U.S. PATENT DOCUMENTS

| | | | | |
|---|---|---|---|---|
| 6,367,514 | B1 * | 4/2002 | Demey | 139/404 |
| 2004/0221915 | A1 * | 11/2004 | Debaes et al. | 139/409 |

FOREIGN PATENT DOCUMENTS

| | | |
|---|---|---|
| EP | 0887449 | 12/1998 |
| EP | 0974690 | 1/2000 |
| EP | 1046734 | 10/2000 |

* cited by examiner

METHOD FOR WEAVING FABRICS WITH AREAS HAVING A CORDED STRUCTURE WITH A LARGE VARIETY OF COLOUR EFFECTS

This application claims the benefit of Belgian Application No. 2005/0547 filed Nov. 10, 2005, which is hereby incorporated by reference in its entirety.

BACKGROUND OF THE INVENTION

The present invention relates to a method for weaving a fabric with areas having a corded structure, a backing fabric being woven on a weaving machine by inserting backing weft yarns during weft insertion cycles between binding and tension warp yarns and by inserting pattern-weft yarns outside the backing fabric, where pile warp yarns are covering the pattern-weft yarns forming cords.

This invention likewise relates to fabrics presenting areas with a corded structure, and more particularly to fabrics the areas of which are approaching a loop pile fabric or bouclé fabric and usually referred to as "false bouclé".

Furthermore, this invention relates to a three rapierweaving machine and a rapier weaving machine with four weft insertion means which are provided for weaving fabrics in accordance with the present invention.

From the European Patent Publication EP 974690, the method is known to weave false bouclé fabrics making use of face-to-face weaving techniques, two corded fabrics being obtained presenting a loop aspect by alternately inserting a weft into the backing fabric in each fabric and subsequently two wefts, one of which is interlaced in the backing fabric, the second weft lying on top of the backing fabric, the pile warp yarns being interlaced around this weft and consequently forming a loop fitting tightly around the weft outside the backing fabric. Because of this being fitting tightly around a weft and of the absence of a cavity, because of which the loop is compressible only in a very limited way, such a loop is called a false loop or a "false bouclé". The market shows a great interest in such fabrics, but they have the disadvantage that the colour effects which may be realised within such fabrics have their limitations, because:

- the pile forming the false loop is fitting to the weft outside the backing fabric. In order to avoid, as much as possible the effect of the weft from showing through the pile loops, thicker yarns are used to that purpose. In the face-to-face weaving technique, in order to maintain the choice of colours in each area of the fabric on a maximal level, a pile warp yarn should be provided for each colour desired in every pile warp system (which normally means in every reed dent), the pile warp yarn having the colour desired, in each point of the fabric, being placed around the weft and the other pile warp yarns being hidden as dead pile in the backing fabric. The need to use a thick pile warp yarn so that the weft will be well covered, means that the number of pile warp yarns that may be used per reed dent or per warp system is limited because of the space available;
- false bouclé woven face-to-face has an additional disadvantage compared to fabrics with a cut pile as far as the number of colour effects is concerned. Where with face-to-face weaving of fabrics having a cut pile, the pile-forming warp yarns are alternately interlaced around wefts of both backing fabrics, and therefore the pile is drawn between the two fabrics, a pile-forming pile warp yarn in a false bouclé fabric is interlaced around the wefts in one single fabric only, so that each pile warp yarn has to be present twice in the same reed dent, once for the upper fabric and once for the lower fabric. That is why there are twice as many pile warp yarns per reed dent for the same number of colour effects when weaving the false bouclé compared to the face-to-face weaving of fabrics with a cut pile, or in other words, the capacity of different colours per reed dent is only about half the capacity when weaving false bouclé, compared to face-to-face pile fabrics with a cut pile in case yarns having the same thickness are considered.

Because of this, in most cases, weaving false bouclé is limited to the use of two to three colours per fabric.

It is possible to extend the palette of colours used for the fabric by applying so-called "lathing"; here each warp yarn system (a warp yarn system normally corresponding to the warp yarns in one reed dent) is using the same number of colours (for instance, two or three), however, different colours are used in different warp yarn systems. However, this technique has serious limitations, as designing is regarded.

Changing the distribution of colours among the various warp yarn systems is very time-consuming, because changes have to be carried out in the weaving creel among a large number of bobbins, consequently causing a great risk of making errors, because it is not simple to identify the right bobbin for the right warp yarn system.

In order to realize additional colour effects, it is known from various applications to use weft yarns having different colours.

With flat fabrics it is known, to use a colour selector on a weft exchanger to change the colour and/or the nature of the yarns during successive wefts, in order to obtain additional colour effects in the fabric in this manner.

Here, in those places where the effect of the weft yarn selected should be visible, the weft will be positioned above the warp yarns (seen from the useful face of the fabric). In those places where the effect of a weft yarn should be visualized, this warp yarn will be positioned at the top and the weft yarn will be positioned between the warp yarns or below the warp yarns.

Such fabrics will not offer a solution in case of pile fabrics, because with such fabrics the weft yarns are interlaced by backing warp yarns, in order to form a backing fabric. The function of the backing fabric is to constitute a solid base in which the pile warp yarns may be interlaced tightly and anchored. To put weft yarns systematically on top of the backing fabric might lead to a backing fabric no longer offering any sufficient solidity and be lacking a tight structure for interlacing the pile warp yarns tightly, because of which it would consequently be impossible to guarantee a good pile withdrawal force.

Most of the time, the backing fabric will also comprise tension warp yarns in order to be able to position the wefts inserted in various layers in order to enable higher density of the pile fabric to be obtained and also, as is the case when weaving a false bouclé, to assist to obtain a more distinct cord formation. Bringing weft from the inside of the backing fabric to the outside might likewise disturb this subdivision of the wefts into several layers and therefore endanger the quality of the fabric.

The German publication of the patent DE 19924214 describes a special Jacquard machine for weaving pile fabrics with a large palette of colours by alternating the areas with a cut pile with areas having no pile at all in which colourful effects are realized by means of different weft yarns. By means of this the so-called Italian Jacquard fabrics are woven in which not only the pile warp yarns, but also the backing warp yarns will be activated by a Jacquard machine, and in doing so, allowing to modify the position of the backing warp yarns in areas where there is no pile and this, not only within one warp yarn system but also over different warp yarn systems in order to be able to solve the said problems and to be able to apply the effects of the weft used for weaving flat fabrics also to pile fabrics.

The solution to activate the backing warp yarns by means of a Jacquard machine will cause the investment to be an expensive one and will make the method used and the backing fabric to become complicated.

Furthermore, for weaving false bouclé, it is customary, already for a longer period, to use a coloured yarn or a yarn with a special effect as a weft yarn lying on top of the backing fabric and to prevent this weft yarn in certain places from being interlaced by a pile warp yarn. This will provide an additional possibility for a variety of colour with respect to the use of pile warp yarns only, but it has the great disadvantage that it is only possible to add one additional colour or effect which, moreover, is the same colour or effect each time across the width of the weaving machine (in the weft direction).

SUMMARY OF THE INVENTION

The purpose of the invention is to define a method enabling to extend the palette of colours and/or the palette of effects in false bouclé fabrics or in fabrics comprising at least a part which is woven as a false bouclé and enabling the colours provided to be used in a very flexible manner at a limited investment allowing a great freedom for designing and which, preferably, will also enable to modify one or several colours rapidly and at low risks.

The purpose of the invention is attained by providing a method for weaving a pile fabric with areas having a corded structure, a backing fabric being woven on a weaving machine by inserting backing-weft yarns during successive weft insertion cycles between binding and tension warp yarns, while pattern-weft yarns are inserted outside the backing fabric and, in a cord forming manner, are covered by pile warp yarns, successive series of at least two different pattern-weft yarns being inserted into the pile fabric in one or several areas having a corded structure, and where at least one pattern-weft yarn of each series is running essentially above the warp yarns in a first part of its trajectory and will be pattern-forming, and in a second part of its trajectory is essentially covered by pile warp yarns, so that a predefined pattern will be formed.

This method enables the palette of colours and/or the palette of effects to be modified with weft effects across the width of the weaving machine (=weft direction) and therefore with additional colours and/or weft effects with respect to what was possible with the methods known from the state-of-the-art.

The expression "essentially above the warp yarns" within the scope of this patent application does not exclude the fact that also pile warp yarns may be running above the pattern-weft yarns within the well-defined trajectory in order to interlace these pattern-weft yarns. This term is relating to the predominant colour and/or effect given to the fabric by the pattern-weft yarn within the said trajectory.

The term "area" within the scope of this patent application must be considered as being part of the fabric having well-defined dimensions in the weft direction of the fabric in accordance with the distance across the weft yarns of one (or several) series of weft yarns on the one hand, and of well-defined dimensions in the weft direction in accordance with part of the width of the weaving machine on the other hand.

In a preferred method according to the invention, there are at least two different pattern-weft yarns for each series in the pile fabric in one or several areas having a corded structure, each of which running essentially above the warp yarns in a first part of their trajectories and are forming the pattern and each of which are covered by pile warp yarns in an essentially cord-forming manner in a second part of their trajectories, the places of the fabric of the first and second trajectories of each weft yarn being determined as a function of a predetermined pattern or design.

In a preferred method according to the invention at least one first pattern-weft yarn is running essentially above the warp yarns which is forming the pattern in the pile fabric in one or several areas having a corded structure in each of the series of pattern-weft yarns, while at least one other second pattern-weft yarn is covered by pile warp yarns in an essentially cord-forming manner.

In another advantageous method according to the invention at least two pattern-weft yarns in each of the series are running essentially above the warp yarns in the pile fabric in one or several areas having a corded structure, along a well defined part of their trajectories.

In a more preferred method according to the invention different areas having a corded structure are created in the pile fabric extending side by side in the weft direction, in a first area, at least one first pattern-weft yarn essentially is running above the warp yarns and forming the pattern, while at least one second pattern-weft yarn being covered by pile warp yarns in an essentially cord-forming manner, and in a second area the said first pattern-forming weft yarn being covered by pile warp yarns in an essentially cord-forming manner, whereas the said second pattern-weft yarn is running essentially above the warp yarns and is forming the pattern.

Because of this, the differences in colour and/or effect between the different areas in the lateral direction of the fabric are still more pronounced, because certain colours and/or effects are not found in the different areas which indeed are found in other areas and vice versa.

In a more particular method according to the invention the pattern-weft yarns are mutually different in each series, as, for instance, because of one or several of the following properties: colour, thickness, material of the yarn and fluffiness.

In a more preferred method according to the invention a series with at least two different pattern-weft yarns, is comprising at least three pattern-weft yarns, at least two pattern-weft yarns of the said series being identical.

According to a preferred method, a number of series with at least two different pattern-weft yarns being mutually identical as property and number of the pattern-weft yarns are concerned. More particularly, at least one series with at least two different pattern-weft yarns, property and/or number of the pattern-weft yarns of which are different as to property and/or number of the pattern-weft yarns of the said series which are mutually identical.

Because of this a kind of "lathing" effect in the weft direction is realized, which has the advantage with respect to "lathing" in the warp direction, that for this switch only one bobbin and only one additional selection element on the weft exchanger is needed. Variation of the pattern-weft yarns in the longitudinal direction of the fabric may occur by activating the weft-selector of the weaving programme, it is therefore no longer needed, as is the case with a "lathing" in the warp direction, to change a series of bobbins in the weaving creel.

In a preferred method according to the invention, the said pattern-weft yarn, each time after a number of warp yarn systems, is interlaced by pile warp yarns in the said first part, where it is running above the warp yarns in the first part of its trajectory and where the pattern is formed. Preferably, the said number of warp yarn systems is situated between 1 and 11, more particularly the said number of warp yarn systems is five.

This will prevent the pattern-weft yarn from layin unstable on the fabric in the first part of its trajectory and from being easily damaged or prematurely subjected to wear during weaving, treatment or normal use.

In a more particular method according to the invention, for interlacing the said pattern-weft yarn running above the warp yarns and forming the pattern in the first part of its trajectory, a pile warp yarn is used which is thinner than the pile warp yarns interlacing cord formingly, which are covering the pattern-weft yarn.

In a most particular method according to the invention the said pattern-weft yarn running above the warp yarns in the first part of its trajectory and forming the pattern, is interlaced by a pile warp yarn of a colour, the aspect of which is corresponding with the said pattern-weft yarn. Because of this, the said pattern-weft yarn is fixed without disturbing the colour effect of the weft yarn concerned.

In a further particular method according to the invention, two pattern-weft yarns of a series running above the warp yarns together side by side along part of their trajectories and are forming the pattern, are interlaced by a same pile warp yarn in one single false loop. By situating both weft yarns next to one another on the surface, forming the pattern, and interlacing them together into one single false loop, another additional colour effect is realized from the combination of the two pattern-weft yarns.

In an advantageous method according to the invention, the backing fabric is woven by means of a cam disk or a dobby machine. Because the backing fabric can be formed in a manner independent of the pattern-weft yarns, it will be possible to manufacture a strong backing fabric, without the aspect (for instance as colour is concerned) and volume (for instance with respect to fluffiness) of the upper pattern-weft yarns, being disturbed.

According to a preferred method, the pile fabric with areas having a corded structure, is woven on a three-rapier weaving machine having a weft selector on the central rapier. Preferably the weft selector is activated in order to select the pattern-weft yarns as a function of the pattern or design desired and to present them to the rapiers.

More particularly the said pile fabric is a face-to-face fabric, the weft selector being activated in order to insert an identical pattern-weft yarn two times in succession, so that each time one pattern-weft yarn will be part of the lower fabric and one pattern-weft yarn will be part of the upper fabric. This way of operating has the great advantage that less switches are required from the weft selector, which will be to the benefit of the life span of the weft selector and the efficiency of the weaving process.

In another preferred method according to the invention, the pile fabric with areas having a corded structure is woven on a rapier weaving machine with four weft insertion means, a device being linked up to the two central weft insertion means by means of which different pattern-weft yarns may be inserted.

In a more particular method according to the invention the pile fabric with areas having a corded structure is woven on a single piece weaving machine, the said machine being provided with two weft insertion means situated one above the other, a first weft insertion means inserting the wefts for the backing fabric and the second weft insertion means operating in conjunction with an equipment to select different pattern-weft yarns successively and to present them to the weft insertion means.

Another subject of the present patent application relates to a pile fabric with areas having a corded structure, comprising:

a backing fabric constituted of backing warp yarns, binding and tension warp yarns;

pattern-weft yarns having been inserted outside the backing fabric and being covered by the pile warp yarns forming cords;

successive series of at least two different pattern-weft yarns having been inserted into the fabric and at least one pattern-weft yarn in each series is running essentially above the warp yarns in a first part of its trajectory and forming the pattern, and is covered by warp yarns forming cords in a second part of its trajectory, so that a predetermined pattern or design will be formed.

In a preferred embodiment of the pile fabric according to the invention, the fabric is comprising at least one area having cut pile.

In a particular embodiment of the pile fabric according to the invention the said pile fabric is formed in accordance with a method according to any one of the claims 1 up to and including 20.

A further subject of the present patent application relates to a three rapier weaving machine, the said weaving machine being provided for weaving a pile fabric with areas having a corded structure manufactured according to any one of the claims 1 up to and including 20.

More particularly, the said weaving machine comprises a weft selector being provided on the central rapier.

Furthermore, the present patent application comprises a rapier weaving machine with four weft insertion means, the said weaving machine being provided for weaving a pile fabric with areas having a corded structure which has been manufactured in accordance with any one of the claims 1 up to and including 20. More particularly the said weaving machine is comprising a weft selector being provided on the two central rapiers.

In order to further clarify the properties of the present invention, and to indicate its additional advantages and particulars, a more detailed description of the method according to the invention and various embodiments of pile fabrics woven by means of a method according to the invention will now follow. It may be obvious that nothing of the following description may be interpreted as being a limitation of the protection of the method and the device according to the invention demanded for in the claims.

Furthermore, some of these embodiments will be discussed in the figures attached to the present, reference being made to these figures by means of reference numbers, where:

DETAILED DESCRIPTION OF THE PREFERRED EMBODIMENTS

Figure 1A:
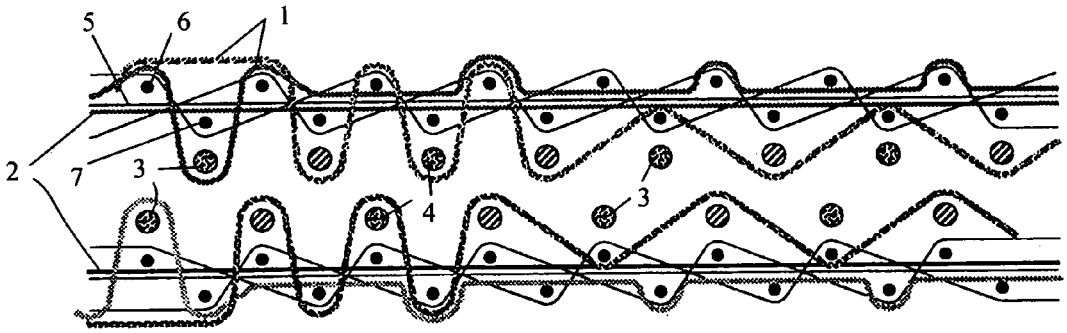
FIG. 1*a, b, c* is representing three warp yarn systems from an area of a face-to-face fabric according to the invention.

In order to add more than one colour as a weft effect across the lateral width (weft direction), successive series of at least two different pattern-weft yarns (3, 4) are inserted in the method according to the invention, at least one pattern-warp yarn in each series running essentially above the warp yarns in a first part of its trajectory and forming the pattern, and in a second part of its trajectory being covered by pile warp yarns in an essentially cord-forming manner, so that a predetermined pattern or design is formed.

In a fabric, different areas having a corded structure are created. The said areas are a part of the fabric having a well-defined dimension in the warp direction of the fabric in accordance with the distance across the weft yarns of one (or several) series of weft yarns on the one hand, and a well-defined dimension in the weft direction in accordance with part of the width of the weaving machine on the other hand. Depending on the method applied, it is possible to form different patterns or designs in the different areas.

When in a preferred embodiment, a number of these different areas are extending in the weft direction of the weaving machine next to one another, the areas created will be different from one another, because certain colours will not be found which are indeed found in the other area and vice versa, because of which it is possible to realize several additional colour effects in the weft direction of the weaving machine.

Preferably, there will be at least two different pattern-weft yarns in each series, each of them running essentially above the warp yarns in a first part of their trajectories and forming the pattern, and each of them, in a second part of their trajectories being covered by pile warp yarns in an essentially cord-forming manner, the places in the fabric of the first and the second trajectory of each weft yarn being defined as a function of a predetermined pattern or design.

According to a preferred method, it is possible to create different areas in the pile fabric having a corded structure, extending in the weft direction next to one another by making at least one first pattern-weft yarn in a first area run essentially above the warp yarns and forming the pattern, while at least one second pattern-weft yarn is covered by pile warp yarns in an essentially cord-forming manner, and in a second area the said first pattern-weft yarn being covered by pile warp yarns in an essentially cord-forming manner, while the said second pattern-weft yarn is running essentially above the warp yarns and is forming the pattern.

In order to weave a pile fabric with areas having a corded structure, when weaving the false bouclé fabric (corded structure), the pattern-weft yarns of a series being inserted successively outside the backing fabric will be varied as to properties, such as, for instance, colour, thickness, material of the yarn and fluffiness (for instance: chenille adding the effect of a low cut pile), etc. The pattern-weft yarn intended to form the pattern in an area, will be situated essentially above the pile warp yarns in this area (on the pile face of the fabric). The pattern-weft yarns not intended to form the pattern in this said area, will be covered by pile warp yarns completely in a cord-forming manner. In this manner it will be possible to realize different colours and effects across the lateral direction of the fabric, using only a limited number of pattern-weft yarns, whereas the number of colours and effects possible to add in this manner is very large. An additional effect is obtained by using all possible variants as warp yarns and to combine them, the variety of warp yarns will show themselves in the differences in colour, thickness, material of the yarn and fluffiness (for instance: chenille, adding an effect is if a low cut pile was used).

In case the device is provided for inserting a pattern-weft yarns alternately in combination with b pile warp yarns it is simply possible to realize a×b different colours and/or effects in each area. It is still possible to increase this number further by selecting a combination of several pile warp yarns within the b pile warp yarns which may be combined with one of the a pattern-weft yarns.

Supposing, for instance, we will consider the situation in which a=2 (a1, a2) and b=3 (b1, b2, b3). Without the invention we have only one pattern-weft yarn (a1 or a2) at our disposition and three pile warp yarns (b1, b2, b3), across the total weaving width and therefore it will be possible to select four colours or effects.

When with the invention pattern-weft yarn a1 and subsequently pattern-weft yarn a2 are inserted alternately, it is only possible to choose the same weft yarn every two pattern-weft yarns to form a pattern. In case the first pattern-weft yarn (a1) is combined with one of the pile warp yarns or a combination of pile warp yarns to cover the second pattern-weft yarn (a2), in case there are three pile warp yarns, the following colour and effect combinations will be obtained: three variations in colour and effect by combining the first pattern-weft yarn (a1) with one of each of the three pile warp yarns+three variations in colour and effect by combining the first pattern-weft yarn (a1) with a combination of two of the three pile warp yarns+ one variation in colour and effect by combining this pattern-weft yarn (a1) with the three pile warp yarns simultaneously. This will enable us to realize at least 7 variations as to colour and effect with the first pattern-weft yarn. The same variations in colour and effect may be realized with the second pattern-weft yarn (a2) in another area extending across the width of the fabric in the weft direction, so that in one area extending across the width of the fabric in the weft direction at least fourteen variations as to colour and effect may be realized already. The number of variations in colour and effect in an area extending across the width of the fabric in the weft direction may still be increased by, in case of a combination of a pattern-weft yarn with several pile warp yarns, making the number of pile warp yarns of one type in the area be different from the number of pile warp yarns of the other type in the area (for instance: two or three times the pile warp yarn b1 and one time the pile warp yarn b2).

The combinations of the different pile warp yarns with one pattern-weft yarn are likewise possible when only one colour or effect of the weft yarn is used.

Making use of the invention means that the number of variations in colour and effect will be increased by a multiple equal to the number of pattern-weft yarns added.

As the pattern-weft yarns (varying as to colour and/or effect); are situated outside the backing fabric, the backing warp yarns may be driven by the usual means, such as a cam disk machine or a dobby machine in a repeating pattern in order to constitute a strong backing fabric, together with the backing warp yarns, independently of the pattern-weft yarns, without disturbing the aspect (for instance as to the colour) and the volume (for instance as to the fluffiness) of the pattern-weft yarn lying on top. The complexity and the cost of the device may be kept low because only the pile warp yarns are activated by means of a Jacquard machine.

Figure 1B:
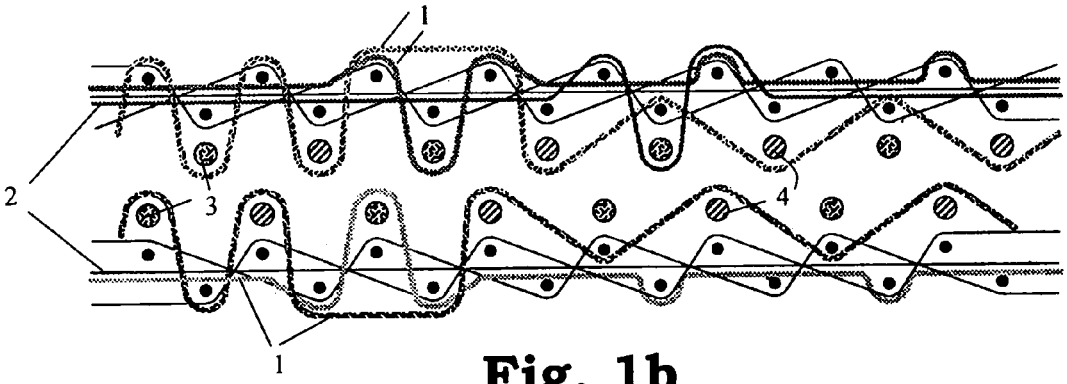
Figure 1C:
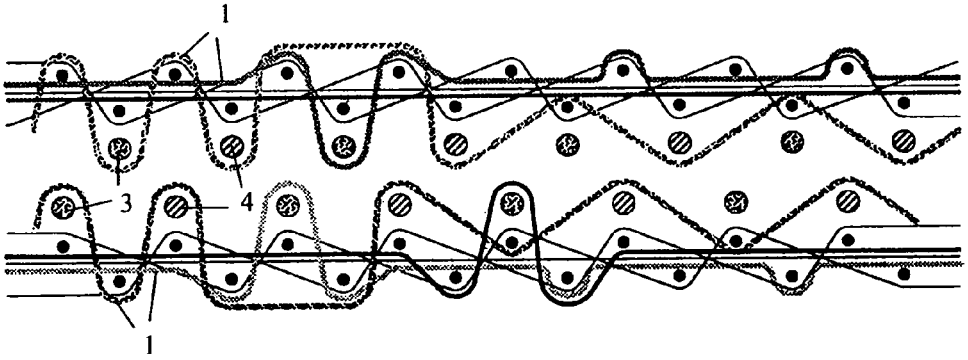

As already mentioned before, different patterns or designs may be realized in the various areas depending on the method applied. FIG. 1*a, b, c* is representing three warp yarn systems from an area of a face-to-face fabric according to the invention. Two fabrics with a corded structure (false bouclé fabrics) are woven one above the other. Pile warp yarns (1) are interlacing first (3) and second (4) pattern-weft yarns in places where none of these weft yarns, forming the pattern, are situated on the surface of the fabric. (above the warp yarns on the pile face. In this area only the first pattern-weft yarns are pattern forming. Thin pile warp yarns (2), for instance, a heat set polypropylene yarn, preferably with a thickness of the order of magnitude of 2600 dtex (in comparison: the cord-forming pile warp yarn of a false bouclé may be of a thickness, for instance, of the order of magnitude of 5200 dtex), are interlacing the said first pattern-weft yarn (3) after a certain number of warp yarn systems (varying between one and eleven, preferably about five). This in order to prevent the first pattern-weft yarn from being unstable laying on top of the fabric and from being easily damaged during weaving, treatment or normal use or from being subject to premature wear. In FIG. 1 this is not the case in the area represented in a first warp yarn system (FIG. 1*a*), in a second warp yarn system (FIG. 1*b*) it is the case for the upper fabric and as it is the case in the third warp system (FIG. 1*c*) for the lower fabric. The pile warp yarns (1) are switching as to pile-forming within their fabric (upper or lower).

In a preferred embodiment, fixing the pattern-weft yarn may occur without disturbing the colour effect of this pattern-weft yarn, by providing the thin pile warp yarn, with which the pattern-weft yarns are interlaced after a certain number of warp yarn systems, in the same colour as the pattern-weft yarn to be fixed.

By providing a thin pile warp yarn per warp yarn system having a corresponding colour, each pattern-weft yarn may be interlaced by a thin pile warp yarn having the corresponding colour, when forming the pattern is extending over a large number of warp yarn systems. Since only thin warp yarns are concerned, several of these different thin warp yarns may be easily provided per warp yarn system. Since, when a pattern-weft yarn is forming the pattern across several successive warp yarn systems, this fixing the pattern-weft yarns by interlacing by means of a thin pile warp yarn, does not occur in each warp yarn system, it is possible to use only one thin pile warp yarn for each colour and for each warp yarn system, the thin pile warp yarn of one colour being used in a first warp yarn system for the lower fabric and in a next warp yarn system for the upper fabric. In order to reduce the occupation per warp yarn system still further, it is possible to provide part of these thin pile warp yarns with certain colours in one warp yarn system, while the remaining colours for thin pile warp yarns are distributed among the neighbouring warp yarn systems. Thus, for instance, in case of two pattern-weft yarns which may be forming the pattern and two corresponding colours of thin pile warp yarns, it is possible to provide the first thin pile warp yarn alternately in one warp yarn system, its colour corresponding with the first pattern-weft yarn and in this warp yarn system may be used in any place, both for the upper and the lower fabric, whereas in the adjoining warp yarn system the second thin warp yarn is provided, the colour of which is corresponding with the second pattern-weft yarn and in this warp system may be used in turn either for the upper fabric or for the lower fabric.

According to the method according to the invention, it will be possible to obtain a particular effect by providing all pile warp yarns as thin pile warp yarns. In this manner, the pattern-weft yarn inserted will become visible, to some extent, all over the surface of the fabric, whereas in those places where the pattern-weft yarn is running essentially above the warp yarns, the weft effect is clearly more pronounced.

A pile warp yarn (1) in these fabrics may be floating on the pile face, because in false bouclé fabrics, this pile warp yarn is not cut through on the pile face and because of this, there is no risk that a floating pile on the back might be pulled out of the fabric because it has not been interlaced sufficiently.

Pile warp yarns (1) not forming the pattern are interlaced in the backing fabric running with the tension warp yarn (5), but may also be interlaced from time to time around a backing warp yarn (6) situated on the back of the fabric.

Figure 2A:
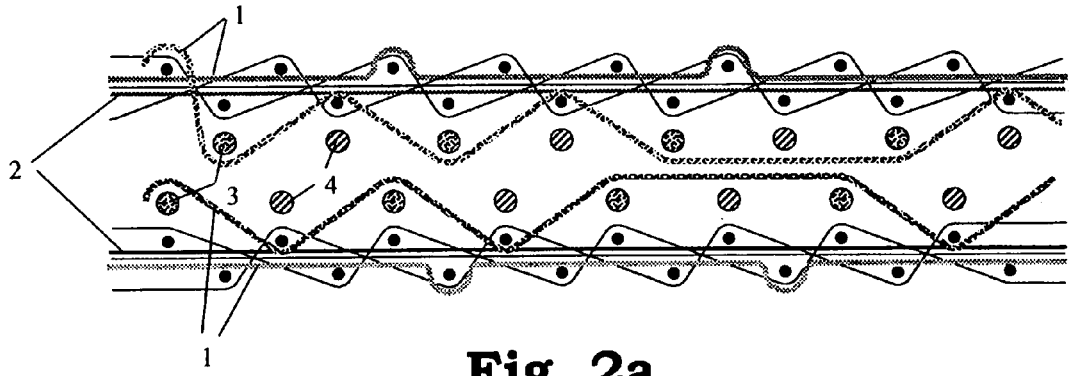
FIG. 2*a, b, c* is representing three warp yarn systems in an area situated in the weft direction next to the area from FIG. 1 from a face-to-face fabric according to the invention in which a second pattern-weft yarn is situated on the surface of the fabric forming the pattern, being interlaced from time to time by a thin pile warp yarn.

FIG. 2*a, b, c* is representing three warp yarn systems in an area which, in the weft direction, is situated next to the one in FIG. 1 in a face-to-face fabric according to the invention in which a second pattern-weft yarn (4) is situated forming the pattern on the surface of the fabric and will be interlaced, from time to time, by means of a thin pile warp yarn (3). FIG. 2*a* and FIG. 2*c* are representing how it is possible for the pile warp yarn (1), forming the pattern, to float also on the pile across several pattern-weft yarns (3, 4).

Figure 2B:
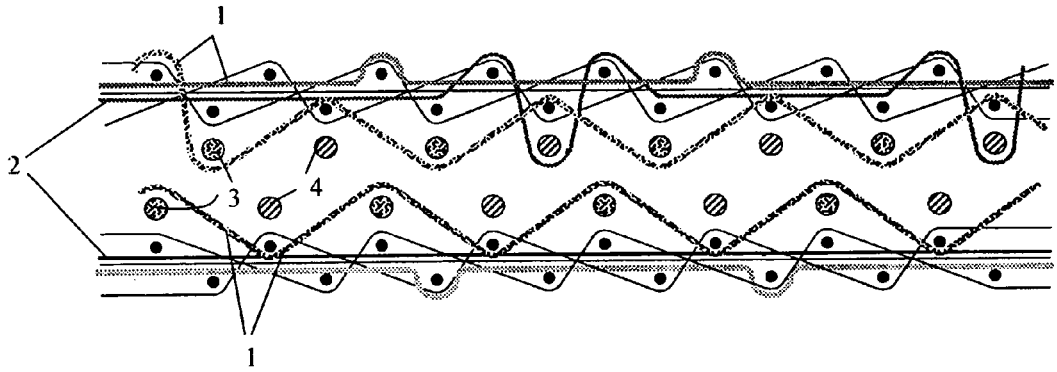
Figure 2C:
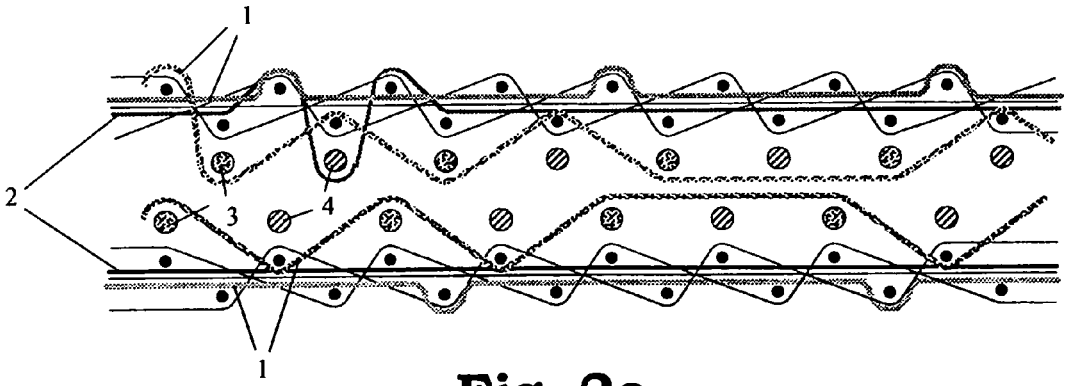
Figure 3A:
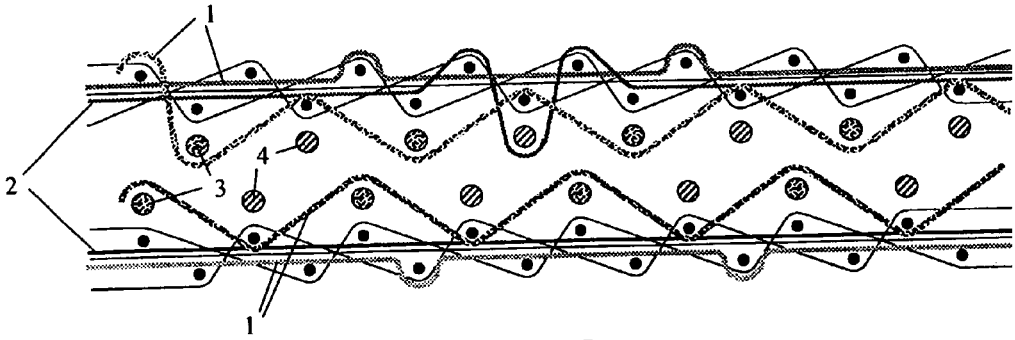
FIG. 3 is representing three warp yarn systems in an area which, for instance, is situated in the weft direction next to the zones from the FIGS. 1 and 2 from a face-to-face fabric according to the invention, in which, in the various warp yarn systems, two pattern-weft yarns are situated on the upper face of the fabric forming the pattern.
Figure 3B:
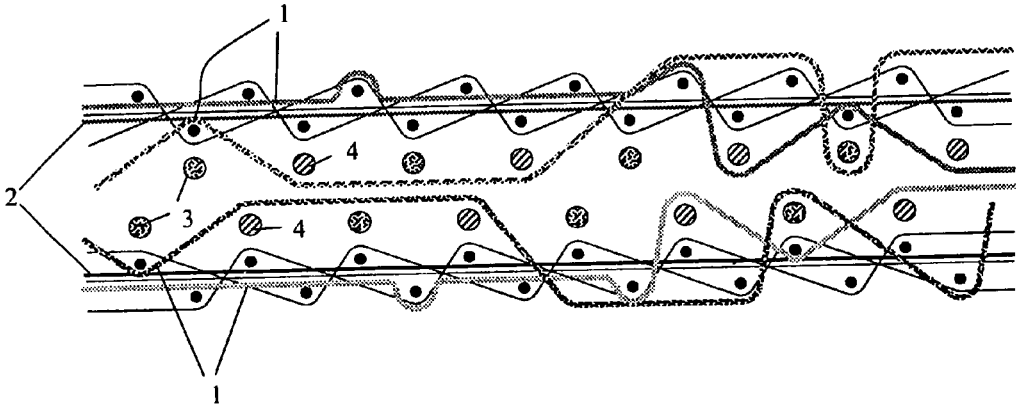
Figure 3C:
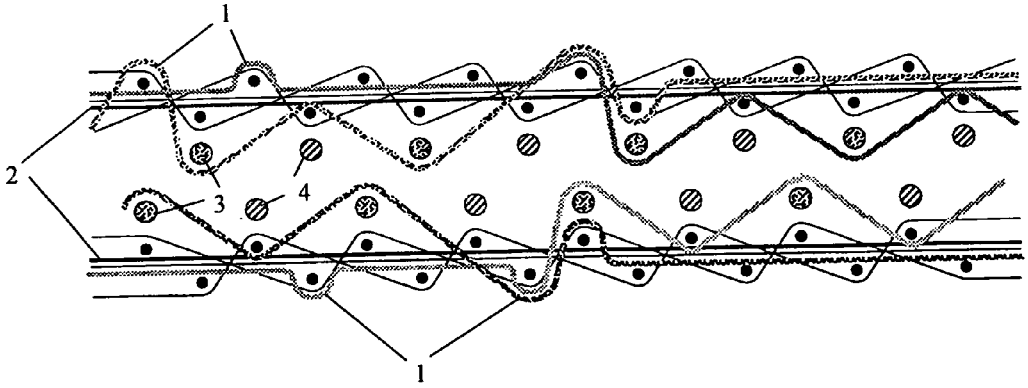

FIG. 3 is representing three warp yarn systems of an area which, for instance, is situated next to the areas of FIGS. 1 and 2 in a face-to-face fabric according to the invention in which in the various warp yarn systems two pattern-weft yarns (3, 4) are situated on the upper face of the fabric forming the pattern.

Fabrics according to the present invention may be woven, making use of a face-to-face weaving technique on a weaving machine having three weft insertion means above one another (three rapier weaving machine), the central weft insertion means alternately inserting a pattern-weft yarn into the lower fabric and into the upper fabric whereby the pattern-weft yarn is situated outside the backing fabric. The central weft insertion means is equipped with a switching device (weft selector) in order to be able to select different pattern-weft yarns (3, 4) successively, before they will be inserted into the shed.

It is likewise possible to weave the fabrics according to the invention on a single piece weaving machine with two weft insertion means situated above one another, a first weft insertion means inserting the backing weft yarns (6, 7) for the backing fabric and a second weft insertion means inserting the pattern-weft yarns situated outside the backing fabric. The second weft insertion means is provided with an equipment, preferably a weft selector, in order to be able to select different pattern-weft yarns (3, 4) successively.

By means of the single piece weaving machine it is possible to manufacture fabrics in which two wefts are inserted during each machine cycle:

one weft into the backing fabric (backing weft yarn (6, 7);

one weft (with colour effect and exchangeable) outside the backing fabric (pattern-weft yarn (3, 4).

This will increase the density of the number of false loops compared to the method described for the three rapier weaving machine.

With a weft disengaging mechanism or a weft cancellation mechanism on the weft insertion means, inserting the pattern-weft yarn outside the backing fabric, it is also possible to make use of a method in which in successive machine cycles:

first a weft is inserted by means of each of the weft insertion means: one backing weft yarn (6, 7) into the backing fabric and one pattern-weft yarn (3, 4) outside the backing fabric;

then, only by means of the weft insertion means, inserting a backing weft yarn (6, 7) into the backing fabric, a backing weft yarn (6, 7) is inserted.

It is quite obvious that said fabrics may also be manufactured in face-to-face weaving technique on single and double rapier weaving machines, the wefts situated above one another being inserted in successive machine cycles. This method has indeed the disadvantage that the production output will be significantly lower than is the case with a three rapier weaving machine, because in order to insert the same number of wefts (backing and pattern-weft yarns) into the fabric half the number of machine cycles has to be operated in surplus. Furthermore both weft insertion means have also to be equipped with a weft selector.

Finally it is possible that the fabrics according to the invention into which in each machine cycle two wefts are inserted one above the other, are woven on a face-to-face weaving machine with four weft insertion means above one another, a device (weft selector) being connected to the two central weft insertion means, with which different pattern-weft yarns (3, 4) may be inserted successively.

In the FIGS. 1, 2 and 3 the pattern-weft yarns (3, 4) are inserted by the central rapier with a weft selection, each time, a first pattern-weft yarns (3) is inserted two times in succession first, whereas subsequently a second pattern-weft yarn (4) is inserted two times in succession, whereas a first and a second pattern-weft yarn are succeeding one another alternately in both the upper and the lower fabric.

Figure 4:
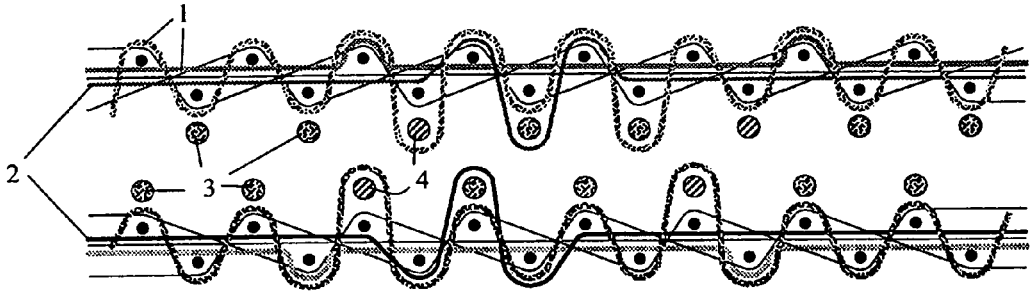
FIG. 4 is representing a warp yarn system from an area having a corded structure, woven in accordance with the invention, a first pattern-weft yarn being inserted twice in succession into each fabric each time.

On the other hand, FIG. 4 is representing a warp yarn system from an area having a corded structure, woven in accordance with the method according to the invention, where each time a first pattern-weft yarn is inserted twice in succession into each fabric (four times in succession by means of the central rapier and then once a second pattern-weft yarn (4) into each fabric (two times in succession by means of the central rapier). In this fabric also the two different pattern-weft yarns (3, 4), become also visible one after the other on the pile face, represented in the weft cycles 12 and 14 for the upper fabric and in weft cycle 11 and 13 for the lower fabric.

Figure 5:
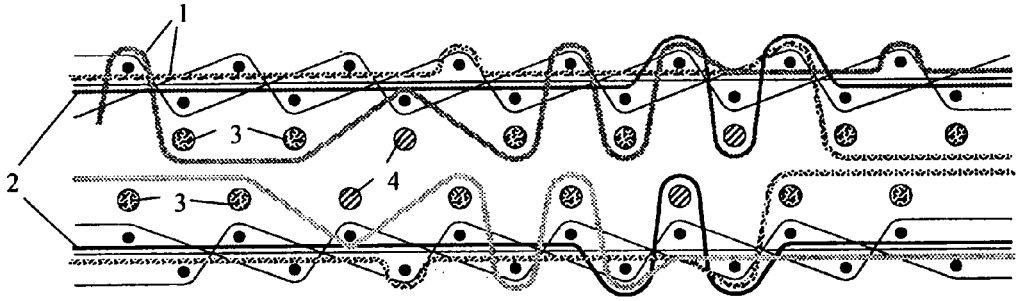
FIG. 5 is representing a warp yarn system from an area having a corded structure, situated in the weft direction next to the area from FIG. 4.

FIG. 5 is representing a warp system from an area having a corded structure, situated next to the area represented in FIG. 4, in this area two identical successive pattern-weft yarns (3) are interlaced several times by one single pile warp yarn (1), floating on the two identical successive pattern-weft yarns (3).

Figure 6:
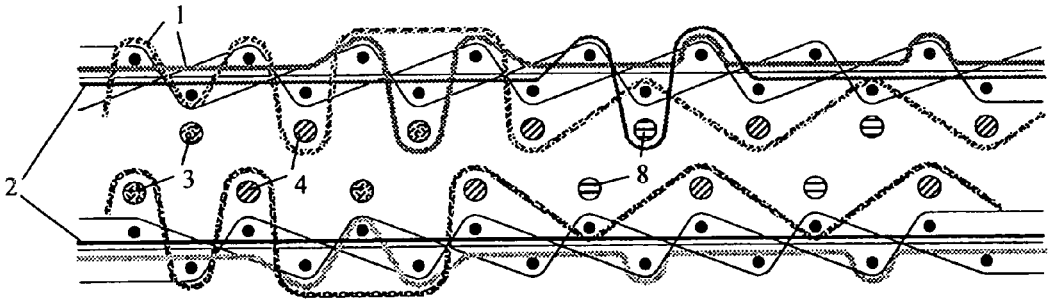
FIG. 6 is representing a warp yarn system from an area having a corded structure, in which in successive series of the pattern-weft yarns, a series is starting in which one of the two pattern-weft yarns is replaced by a third pattern-weft yarn.

FIG. 6 is representing a warp yarn system from an area having a corded structure, in which in successive series of the pattern-weft yarns (3, 4) a series starts in which one of the two pattern-weft yarns (3 or 4) is replaced by a third pattern-weft yarn (8). Because of this an effect is obtained which is comparable with lathing in the warp direction.

Figure 7:
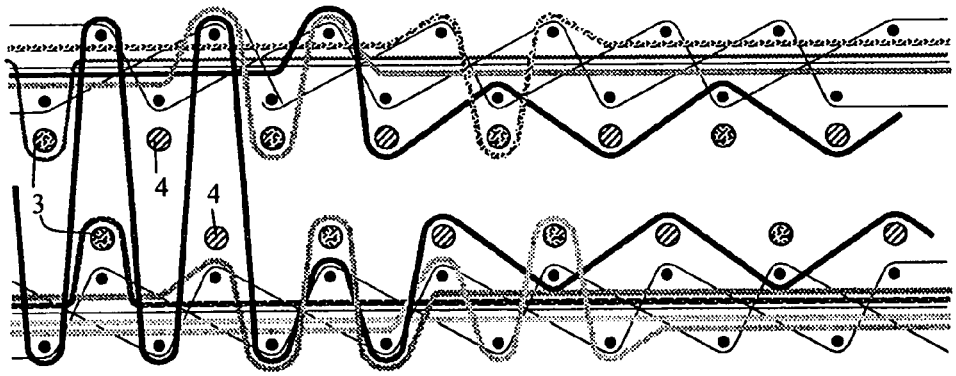
FIG. 7 is representing a fabric with areas having a corded structure, woven in accordance with the method according to the invention, in which apart from areas having a corded structure (false bouclé) also an area with a cut pile is formed.

It is also possible to create a particular effect by providing one or several areas with a cut pile in the fabric next to the areas having a corded structure (false bouclé), as represented in FIG. 7. Here, a pile warp yarn will be interlaced alternately around a weft in the backing fabric of the lower fabric and around a weft of the backing fabric of the upper fabric and will extend in between from the lower fabric to the upper fabric, furthermore the pile warp yarns extending between the two fabrics will be cut through between the two fabrics.

Figure 8:
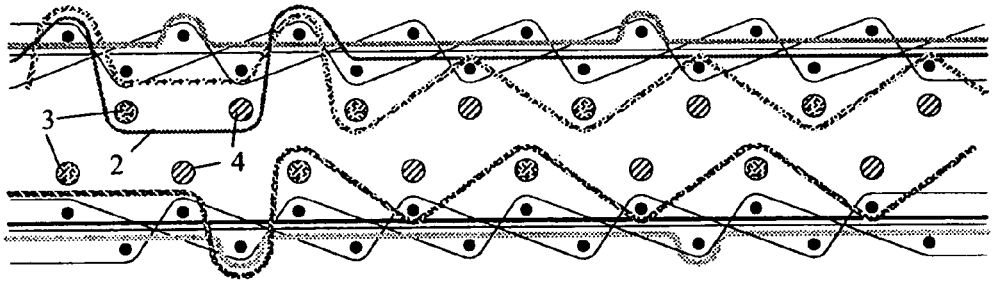
FIG. 8 is representing an area of a fabric according to the invention, two pattern-weft yarns being inserted in succession into the lower fabric or into the upper fabric, being situated next to one another on the surface of the fabric.

FIG. 8 is representing an area of a fabric according to the invention in which two pattern-weft yarns (3, 4) inserted successively into the lower and the upper fabric are situated on the face of the fabric next to one another. In the representation of FIG. 8 the two pattern-weft yarns (3, 4) are interlaced together in the upper fabric by a thin pile warp yarn (2). This last point will assist the two pattern-weft yarns to realize together an effect that is different from the separate pattern-weft yarns.

What is claimed is:

1. Method for weaving a pile fabric with areas having a corded structure, a backing fabric being woven on a weaving machine by inserting backing-weft yarns (6, 7) during successive weft insertion cycles between binding and tension warp yarns, whereas pattern-weft yarns (3, 4) are inserted outside the backing fabric and are covered by pile warp yarns (1), forming cords, characterized in that successive series of at least two different pattern-weft yarns (3, 4) are inserted into the pile fabric in one or several areas having a corded structure and in that at least one pattern-weft yarn (3, 4) of each series is running essentially above the warp yarns in a first part of its trajectory and is forming the pattern, and is covered by pile warp yarns (1) essentially forming cords in a second part of its trajectory, so that a predetermined pattern or design is formed.

2. Method according to claim 1, characterized in that in the pile fabric in one or several areas having a corded structure, at least two different pattern-weft yarns in each series, each, in a first part of their trajectory, are running essentially above the warp yarns and are forming the pattern, and in a second part of their trajectory are each covered by pile warp yarns, essentially forming cords, and in that the places in the fabric of the first and the second trajectory of each weft yarn are determined as a function of a predetermined pattern or design.

3. Method according to claim 1, characterized in that in the pile fabric, in one or several areas having a corded structure, in each series of pattern-weft yarns at least one first pattern-weft yarn is running essentially above the warp yarns and is forming the pattern, whereas at least one other second pattern-weft yarn is covered by pile warp yarns essentially forming cords.

4. Method according to claim 1, characterized in that in the pile fabric, in one or several areas having a corded structure, in each series, at least two pattern-weft yarns are running essentially above the warp yarns along a well-determined part of their trajectory.

5. Method according to claim 1, characterized in that in the pile fabric, different areas having a corded structure are created, extending in the weft direction next to one another, where in a first area, at least one first pattern-weft is running essentially above the warp yarns and is forming the pattern, whereas at least a second pattern-weft yarn is covered by pile warp yarns, essentially forming cords, and in a second area the said first pattern-weft yarn is covered by pile warp yarns, essentially forming cords, whereas the said second pattern-weft yarn is running essentially above the warp yarns and is forming the pattern.

6. Method according to claim 1, characterized in that the pattern-weft yarns in each series are mutually different, such as, for instance, by one or several of the following properties: colour, thickness, material of the yarn and fluffiness.

7. Method according to claim 1, characterized in that a series comprising at least two different pattern-weft yarns, will comprise at least three pattern-weft yarns, at least two of the pattern-weft yarns of the said series being identical.

8. Method according to claim 1, characterized in that a number of series comprising at least two different pattern-weft yarns are mutually identical as property and number of the pattern-weft yarn are concerned.

9. Method according to claim 8, characterized in that there is at least one series comprising at least two different pattern-weft yarns, property and/or number of the pattern-weft yarns being different as property and/or number of the pattern-weft yarns of the mutually identical series are concerned.

10. Method according to claim 1, characterized in that where the said pattern-weft yarn is running above the warp yarns and is forming the pattern in the first part of its trajectory, it is interlaced each time by a pile warp yarn in the said first part after a number of warp yarn systems.

11. Method according to claim 10, characterized in that the said number of warp yarn systems is situated between 1 and 11.

12. Method according to claim 10, characterized in that the said number of warp yarn systems is five.

13. Method according to claim 10, characterized in that for interlacing the said pattern-weft yarn, running above the warp yarns in the first part of its trajectory and forming the pattern, a pile warp yarn is used which is thinner than the pile warp yarns covering and forming cords.

14. Method according to claim 10, characterized in that the said pattern-weft yarn, running above the warp yarns in the first part of its trajectory and forming the pattern, is interlaced by a pile warp yarn of a colour which is corresponding with the said pattern-weft yarn as far as its aspect is concerned.

15. Method according to claim 4, characterized in that two pattern-weft yarns of a series running side by side above the warp yarns along part of their trajectories and forming the pattern, are interlaced by a same pile warp yarn in one single false loop.

16. Method according to claim 1, characterized in that the backing fabric is woven by means of a cam disk machine or a dobby machine.

17. Method according to claim 1, characterized in that the pile fabric is woven with areas having a corded structure on a three rapier weaving machine provided with a weft selector on the central rapier.

18. Method according to claim 17, characterized in that the said pile fabric is a face-to-face fabric, the weft selector being activated to insert a same pattern-weft yarn two times in succession, so that one pattern-weft yarn becomes part of the lower fabric and one pattern-weft yarn will become part of the upper fabric.

19. Method according to claim 1, characterized in that the pile fabric with areas having a corded structure is woven on a rapier weaving machine equipped with four weft insertion means, a device being connected to the two central weft insertion means, by means of which it is possible to insert different pattern-weft yarns successively.

20. Method according to claim 1, characterized in that the pile fabric with areas having a corded structure is woven on a single piece weaving machine, the said machine being provided with two weft insertion means being situated above one another, the first weft insertion means inserting the wefts for the backing fabric and the second weft insertion means operating in conjunction with an equipment to select different pattern-weft yarns and to present them to the weft insertion means.

21. Pile fabric with areas having a corded structure, comprising:

a backing fabric consisting of backing weft yarns, binding and tension warp yarns;

pattern-weft yarns being inserted outside the backing fabric and are covered by pile warp yarns forming cords, characterized in that successive series of at least two different pattern-weft yarns are inserted into the fabric and in that at least one pattern-weft yarn of each series is running essentially above the warp yarns and is forming the pattern in a first part of its trajectory and is covered by pile warp yarns essentially forming cords in a second part of its trajectory, so that a predetermined pattern or design is formed.

22. Pile fabric with areas having a corded structure according to claim 21, characterized in that the fabric likewise comprises at least one area having a cut pile.

23. Pile fabric with areas having a corded structure according to claim 21, wherein the fabric is formed by weaving a backing fabric on a weaving machine by inserting backing-weft yarns (6, 7) during successive weft insertion cycles between binding and tension warp yarns, whereas pattern-weft yarns (3, 4) are inserted outside the backing fabric and are covered by pile warp yarns (1), forming cords, wherein successive series of at least two different pattern-weft yarns (3, 4) are inserted into the pile fabric in one or several areas having a corded structure and at least one pattern-weft yarn (3, 4) of each series is running essentially above the warp yarns in a first part of its trajectory and is forming the pattern, and is covered by pile warp yarns (1) essentially forming cords in a second part of its trajectory, so that a predetermined pattern or design is formed.

24. Three or four rapier weaving machine for weaving a pile fabric with areas having a corded structure, comprising first insertion means for inserting backing weft yarns (6, 7) during successive weft insertion cycles between binding and tension warp yarns, and second insertion means for inserting pattern weft yarns (3, 4) outside the backing fabric, where said backing and pattern weft yarns are covered by pile warp yarns (1), forming cords, wherein the second insertion means inserts successive series of at least two different pattern-weft yarns (3, 4) into the pile fabric in one or several areas having a corded structure and at least one pattern-weft yarn (3, 4) of each series is running essentially above the warp yarns in a first part of its trajectory and is forming the pattern, and is covered by pile warp yarns (1) essentially forming cords in a second part of its trajectory, so that a predetermined pattern or design is formed.

25. Three or four rapier weaving machine according to claim 24, characterized in that the said weaving machine comprises a weft selector which is provided on the central rapier.

26. Rapier weaving machine for weaving a pile fabric with areas having a corded structure according to claim 24, comprising four weft insertion means.

27. Rapier weaving machine comprising four weft insertion means according to claim 26, characterized in that the said weaving machine comprises a weft selector provided on each of two central weft insertion means.

* * * * *